United States Patent [19]

Langenfeld et al.

[11] 4,022,445

[45] May 10, 1977

[54] CONVERTER BOTTOM STRUCTURE

[75] Inventors: Wilhelm Langenfeld, Dusseldorf; Klaus Stelzner, Duisburg, both of Germany

[73] Assignee: Didier-Werke AG, Wiesbaden, Germany

[22] Filed: Apr. 30, 1976

[21] Appl. No.: 682,175

[30] Foreign Application Priority Data

May 17, 1975 Germany ..... 2522036

[52] U.S. Cl. ..... 266/224; 266/222

[51] Int. Cl.[2] ..... C21C 5/48

[58] Field of Search ..... 75/60; 266/220–224, 266/243, 245, 247, 280, 281, 283, 265–270

[56] References Cited

UNITED STATES PATENTS

| | | | |
|---|---|---|---|
| 177,118 | 5/1876 | Harbison | 266/224 |
| 177,119 | 5/1876 | Harbison | 266/224 |
| 193,949 | 8/1877 | Haws | 266/224 |
| 372,302 | 11/1887 | Collin | 266/224 |
| 865,671 | 9/1907 | Baggaley | 266/269 |
| 3,397,878 | 8/1968 | Holmes et al. | 266/268 |
| 3,819,165 | 6/1974 | Courard et al. | 266/268 |
| 3,830,481 | 8/1974 | Dominguez et al. | 266/283 |
| 3,938,790 | 2/1976 | Knuppel et al. | 266/224 |

*Primary Examiner*—Gerald A. Dost
*Attorney, Agent, or Firm*—Wenderoth, Lind & Ponack

[57] ABSTRACT

A refractory bottom lining has extending therethrough at least one inclined decarburization or refining nozzle or tuyere. Surrounding the nozzle is an outer perforate brick having a hole therethrough. An inner brick fits within the hole of the outer brick and has a bore which is inclined at the same angle of inclination as the nozzle. The nozzle extends through the bore.

10 Claims, 4 Drawing Figures

CONVERTER BOTTOM STRUCTURE

BACKGROUND OF THE INVENTION

The present invention relates to a nozzle or tuyere bottom structure, in particular for a converter of the type including tubular decarburization or refining nozzles extending in an inclined manner through the bottom plate and refractory bottom lining of the converter bottom.

When the bottom lining is formed as a walled-up nozzle bottom, e.g., as shown in German DT-OS 2,321,909, the nozzles are surrounded in a spaced manner by bricks set with mortar, and the gaps thus formed between the nozzles and the bricks are filled with refractory material. This produces a bottom lining structure wherein the filled refractory material forms weak points with respect to the action and effect of the melt, especially when the filled refractory material is irregularly compressed during the tamping thereof. The filled refractory material thus wears much more rapidly then the bottom bricks. This wear may gradually erode the adjacent bottom bricks and bring about a premature failure of the decarburization nozzles. Furthermore, the necessary tamping of the refractory material filled into the gaps formed during the walling-up of the converter bottom is a very expensive and complex operation.

SUMMARY OF THE INVENTION

The object of the present invention is to improve the quality and flexibility of use of converter bottoms in the areas where decarburization or refining nozzles extend therethrough.

This object is achieved in accordance with the present invention by providing that cylindrical bricks slide over the decarburization nozzles, each cylindrical brick having a bore which is inclined with respect to the axis thereof in the same manner as the respective nozzles. The cylindrical bricks are each positioned in a respective perforate bottom brick having a hole therethrough corresponding to the shape of the respective cylindrical brick. Therefore, even in the areas of the nozzles, the bottom lining may be formed with bricks in the pattern of the other bottom bricks, to thereby produce a structurally uniform refractory bottom lining which is uniformly stable with respect to the action of the melt and which thus protects the decarburization nozzles against premature wear and failure. Furthermore, the converter bottom can be mounted in a simple and speedy manner, with the tubular nozzles aligned to point in any preferred direction within the designed and selected oblique position, in order to achieve a desired movement of the bath suitable for the treatment of the melt. The cylindrical bricks within the cylindrical holes of the perforate bottom bricks will necessarily be aligned in the directions of the nozzles.

The cylindrical bricks and/or the perforate bottom bricks that receive such cylindrical bricks may advantageously be formed as half shells which can possibly be manufactured in a more simple manner than one-piece bricks.

BRIEF DESCRIPTION OF THE DRAWINGS

The invention will be explained in more detail in the following description, taken with the accompanying drawings; wherein.

DETAILED DESCRIPTION OF THE INVENTION

Figure 1:
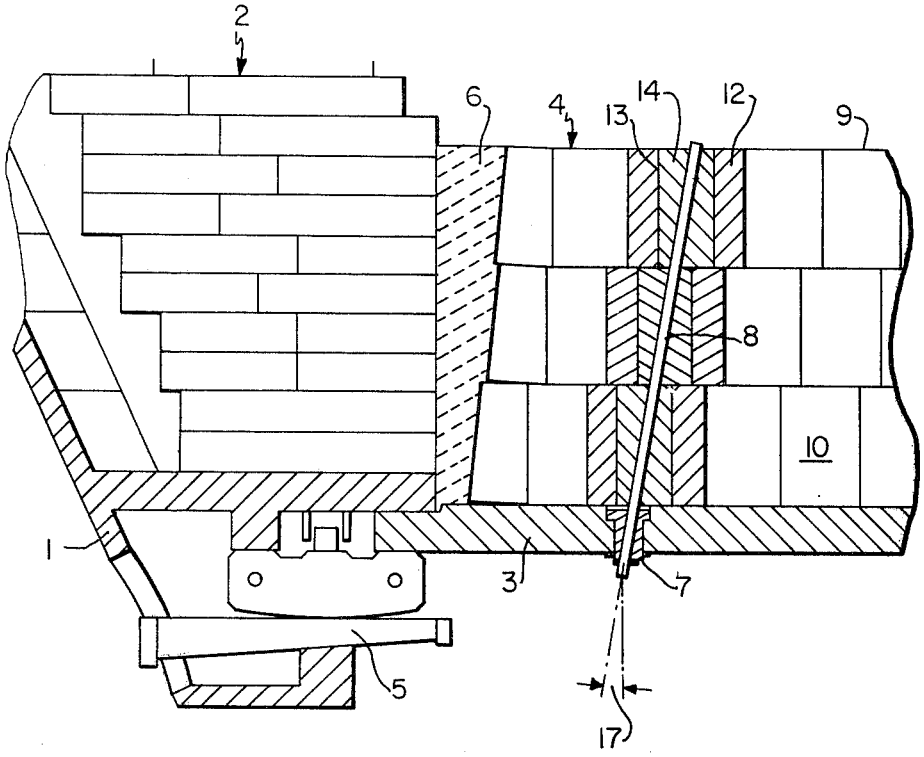
FIG. 1 is a cross-sectional view of a portion of a walled-up nozzle bottom of converter.
Figure 2:
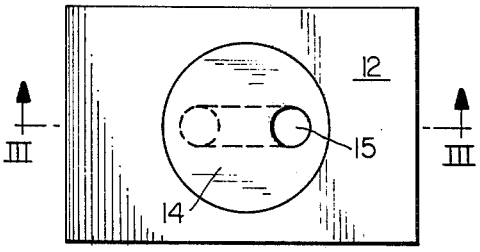
FIG. 2 is a plan view of a brick cover for the converter nozzles.
Figure 3:
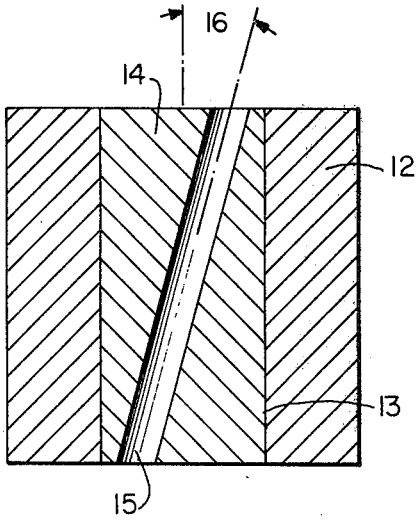
FIG. 3 is a cross-sectional view taken along the line III—III of FIG. 2.

As shown in FIG. 1, a converter includes a metal shell 1 and a refractory wall lining 2. The converter bottom includes a bottom plate 3 and a refractory bottom lining 4, which is prepared outside the converter and is then attached to shell 1 by means such as a wedge coupling arrangement 5. The gap between linings 2 and 4 is then filled with a refractory material 6.

Bottom plate 3 is provided with a number of holders 7 for the attachment of decarburization or refining nozzles or tuyeres 8 in the form of double concentric tubes. The inner end of each nozzle 8 extends above the bottom surface 9 of the converter chamber. The outer, clamped end of each nozzle 8 is provided with connections for the feed of oxygen into the inner tube and for the feed of cooling gas into the outer tube, which connections are known and are thus not shown for the sake of simplicity.

Figure 4:
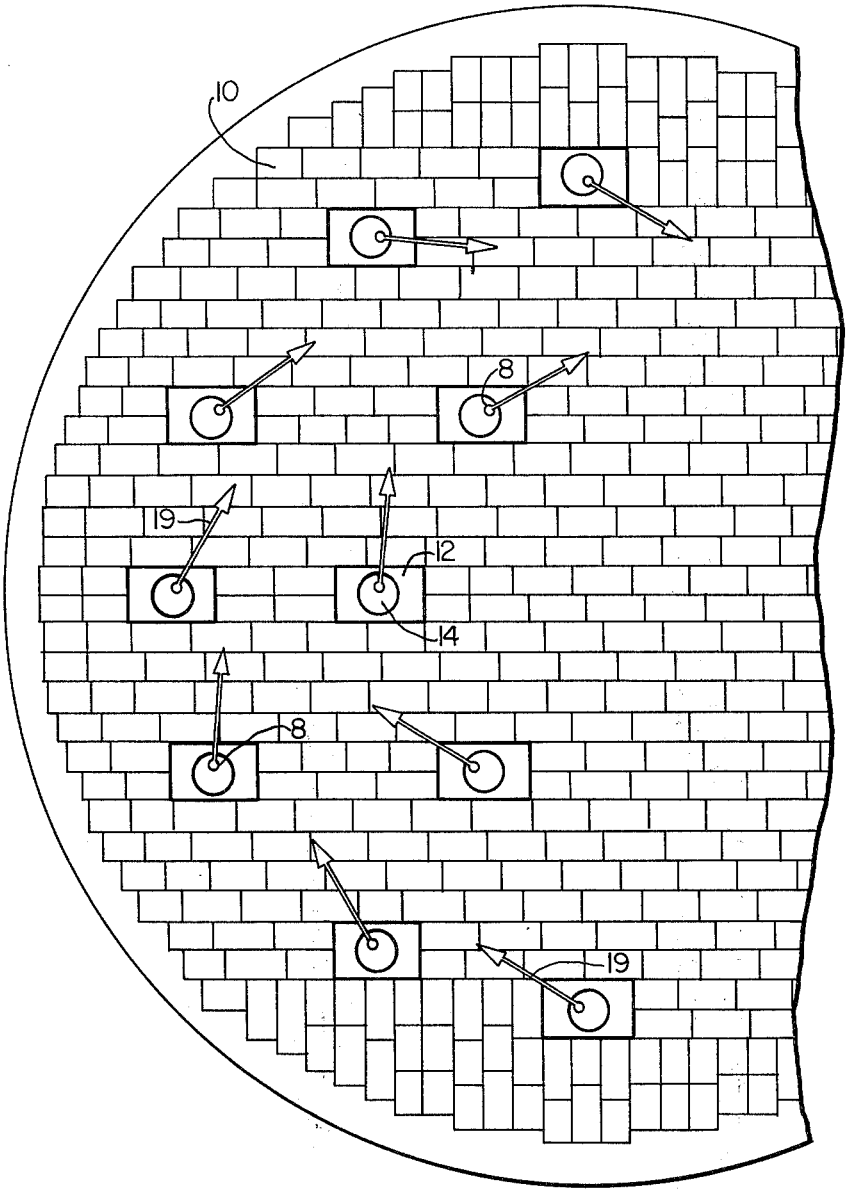
FIG. 4 is a plan view of a nozzle bottom of converter.

Lining 4 of the converter bottom, which is mounted after decarburization nozzles 8 are positioned on bottom plate 3, is formed by solid bottom bricks 10 that are laid and assembled in plural, for example three, superimposed layers, in accordance with a desired pattern, for example the linear pattern shown in FIG. 4. For the encasement of nozzles 8, there are provided perforate outer bottom bricks 12, each having therethrough a cylindrical hole 13 with an inner cylindrical brick 14 arranged therein. Each cylindrical brick 14 has therethrough a bore 15 of a diameter substantially equal to the diameter of decaburization nozzles 8. Each bore 15 is inclined at an angle 16 to the axis of cylindrical brick 14 and to the edges of hole 13. Angle 16 corresponds to an oblique angle 17 at which decarburization nozzles 8 are aligned in relation to a line extending vertically from bottom plate 3.

It will be apparent that bottom lining 2 can be laid in continuous manner with perforate bottom bricks 12, having cylindrical bricks 14 inserted therein and sliding over decarburization nozzles 8. This is true, even when in accordance with an arrangement such as shown in FIG. 4 decarburization nozzles 8 are aligned to point in different directions 19, and to form substantially tangents to imaginary circles on which the metal bath is displaced. In each of the indicated directions, cylindrical bricks 14 are positioned in a different position in relation to the respective perforate bottom bricks 12. An infinite number of nozzle orientations are possible by relative turning of cylindrical bricks 14 in the respective perforate bottom bricks 12.

In addition to use with rectangular bricks, the present invention can be applied, with bricks of other shapes, for example wedge shaped bricks that are employed for forming a bottom lining in the form of concentric brick circles.

The modification of cylindrical bricks 14 into polygonal bricks fitting in corresponding shaped holes in perforate bottom bricks 12 is also within the scope of the invention. However, such an arrangement would not permit an infinite number nozzle alignments, but rather a finite number of nozzle alignments.

It will be apparent that still other modifications may be made to the specifically disclosed structural arrangements without departing from the scope of the invention.

We claim:

1. A converter bottom structure comprising:
a planar refractory bottom lining;
at least one decarburization nozzle extending through said lining at an angle inclined to the plane thereof; and
said lining comprising:
at least one layer of solid bottom bricks assembled in a desired planar pattern, with a gap in said layer where said nozzle extends therethrough;
a perforate outer brick positioned in said gap and surrounding said nozzle, said outer brick having outer surfaces extending transverse to said plane of said lining and contacting complementary surfaces of said layer defining said gap, said outer brick having a hole therethrough extending perpendicular to said plane of said lining; and
an inner brick having an exterior configuration to fit within said hole in said outer brick in contact therewith, said inner brick having therethrough a bore inclined to said plane of said lining at the same angle as said nozzle, said nozzle extending through said bore in said inner brick in contact therewith.

2. A structure as claimed in claim 1, wherein said hole and said exterior configuration of said inner brick are cylindrical.

3. A structure as claimed in claim 1, wherein said hole and dried exterior configuration of said inner brick are polygon shaped.

4. A structure as claimed in claim 1, wheein said outer brick is in the form of two half shells.

5. A structure as claimed in claim 1, wherein said inner brick is in the form of two half shells.

6. A structure as claimed in claim 1, wherein the cross-sectional size of said outer brick is greater than that of said bottom bricks, as viewed in a direction perpendicular to said plane of said lining.

7. A structure as claimed in claim 1, wherein said outer brick has a rectangular configuration, as viewed in a direction perpendicular to said plane of said lining.

8. A structure as claimed in claim 1, wherein said lining comprises plural superimposed planar layers of said bottom bricks; each said layer having therein at least one said outer brick having positioned therein at least one said inner brick.

9. A structure as claimed in claim 1, wherein inner ends of said outer brick and of said inner brick are coplanar with inner ends of said bottom bricks.

10. A structure as claimed in claim 1, wherein said lining has extending therethrough a plurality of nozzles, each of said nozzles being inclined in a different direction.

* * * * *